US005427123A

United States Patent [19]

Odenthal

[11] Patent Number: 5,427,123

[45] Date of Patent: Jun. 27, 1995

[54] HEADBAND KIT

[76] Inventor: Terrance A. Odenthal, 13263 280th St./Rte. 2, Milaca, Minn. 56353

[21] Appl. No.: 258,726

[22] Filed: Jun. 13, 1994

[51] Int. Cl.[6] ..... A45D 8/14

[52] U.S. Cl. ..... 132/275

[58] Field of Search ..... 132/273, 275; 2/171, 2/209.13

[56] References Cited

U.S. PATENT DOCUMENTS

D. 70,296 3/1926 Skaruda .
D. 70,298 6/1926 Skaruda .
D. 90,188 6/1933 Behr .
D. 204,637 5/1966 Mitchell .
D. 205,576 8/1966 Day .
248,542 10/1881 Wilson .
2,849,007 8/1958 Behr .

FOREIGN PATENT DOCUMENTS 642403 8/1928 France ..... 132/273
916749 12/1946 France ..... 132/273

*Primary Examiner*—Robert P. Swiatek
*Attorney, Agent, or Firm*—Burd Bartz & Gutenkauf

[57] ABSTRACT

A headband kit having a base comprised of an open loop of resilient material adapted to fit over the top of the head of a wearer. A backboard extends upwardly from the top of the base, presenting a forwardly facing planar display surface. The kit includes a plurality of display panels interchangeably attachable to the display surface of the backboard, and each carrying a different design or display.

10 Claims, 2 Drawing Sheets

HEADBAND KIT

BACKGROUND OF THE INVENTION

Probably the simplest form of head wear, next to a common ribbon, is the headband, fillet or bandeau. These were worn both by men and women in early societies, chiefly to keep long hair away from the face. Special kinds of head gear, such as the feathered headband of the American Indian warrior, were regarded as symbols of status.

Although head wear has evolved into much more sophisticated forms, the headband has survived to the modern day. The headband takes two forms, that which encircles the forehead and that which extends over the top of the head. The later type of headband is still popular with ladies and particularly with young girls. The headband is worn for purposes of hair control and as an item of decoration as well. The headband typically comes in very decorative forms. However, it is fundamental that to change the decoration, the wearer needs to change the headband, resulting in a headband collection.

SUMMARY OF THE INVENTION

The invention pertains to a headband kit for use by women and particularly, young girls. The kit includes a headband and a number of interchangeable display panels that are releasably fixable to the headband. The headband has a resilient base in the shape of an open loop configured to conform to the top of the head and pass over the head with legs that straddle either side of the head in bearing relationship to it. A backboard extends upwardly from the top of the base to carry a display panel. A number of display panels are included in the kit and have different displays upon them. Means are provided for releasably fixing display panels one-at-a-time to the backboard.

IN THE DRAWINGS

DESCRIPTION OF A PREFERRED EMBODIMENT

Figure 1:
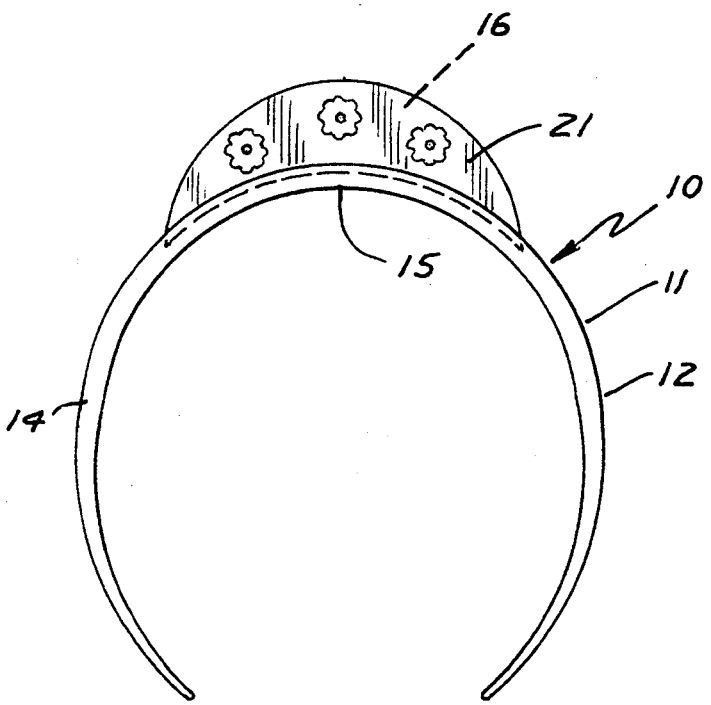
FIG. 1 is a front elevational view of a headband of a headband kit according to the invention, having a display panel installed thereon.
Figure 2:
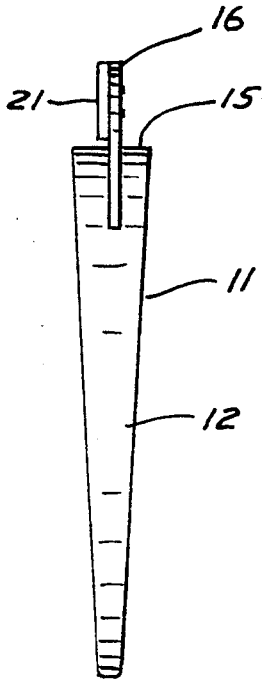
FIG. 2 is a side elevational view of the headband of FIG. 1.

Referring to the drawings, there is shown in FIG. 1 a headband assembly 10 to be worn by women and particularly, young girls. The purpose of the headband assembly 10 is for hair control as well as decoration. Headband 10 includes a base 11 which is curved in shape and configured as an open loop of resilient material such as metal or plastic. Base 10 is configured to fit over the top of the head of the wearer, and has legs 12, 14 that straddle the head and bear against the sides of the head. Legs 12, 14 resiliently spread apart for installation of base 11 on a head. An upper portion or platform 15 extends across the top of the head between the legs 12, 14. As shown in FIG. 2, legs 12, 14 taper downwardly from the platform 15.

As shown in FIGS. 1–4, base 11 carries a backboard 16 for the purpose of carrying interchangeable display panels. Backboard 16 has a lower edge 17 that is situated in a notch 18 circumferentially formed in the platform 15 of base 11, and held therein by suitable means such as glue. Backboard 16 is a planar member that has a front face looking forward when the base 11 is installed on the head to provide a display surface to mount display panels. Backboard 16 is symmetrically posed on the top of the base 11 and is crescent in shape for aesthetic purposes, having an upper edge 20 that is curved in shape and can generally follow a circular arc. Backboard 16 could have other aesthetic shapes as well.

Figure 3:
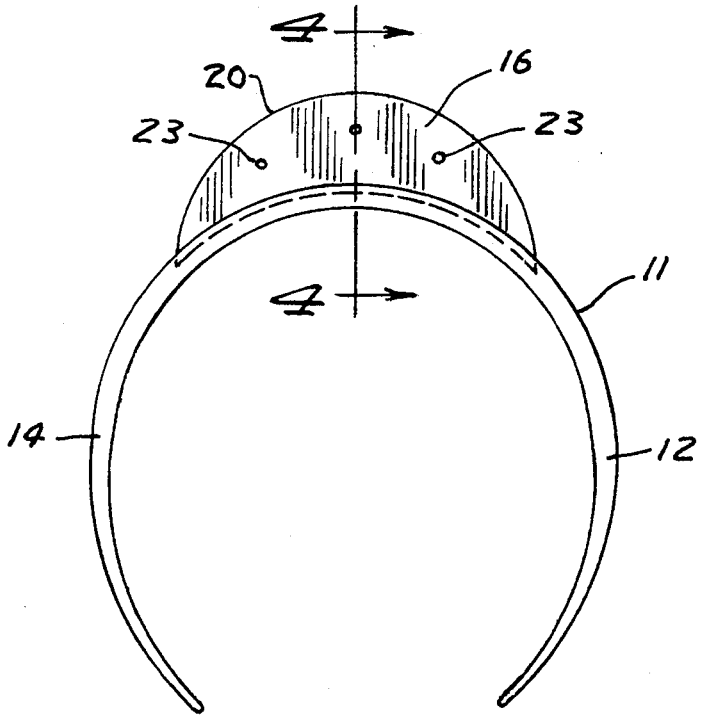
FIG. 3 is a front elevational view of a headband like that of FIG. 1 but with the display panel removed.
Figure 4:
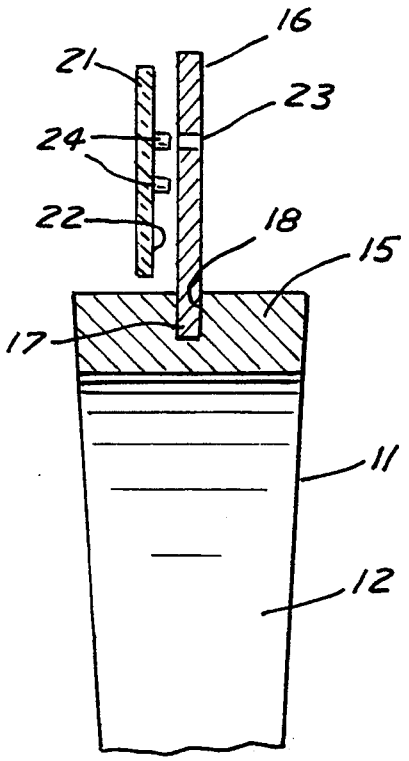
FIG. 4 is an enlarged sectional view showing a portion of the headband structure of FIG. 3 taken along the line 4—4 thereof.

Headband assembly 10, as shown in FIG. 1, carries a removable display panel 21 on the backboard 16 having a floral scene. As shown in FIGS. 3 and 4, the backboard 16 has a plurality of mounting openings 23. The removable display panel 21 has a rear mounting surface 22 with a plurality of mounting pins or pegs 24 which are arranged in formation to register with the mounting holes 23 in friction fit. As shown, three holes are symmetrically placed. Display panel 21 is sized and shaped to substantially cover the front exposed surface of the backboard 16 when attached thereto. Accordingly, display panel 21 can have a truncated-crescent shape.

Display panel 21 is fixed to the backboard 16 simply by inserting the mounting pegs 24 in the corresponding mounting holes 23. It is removed simply by pulling it away from the backboard 16.

Figure 5:
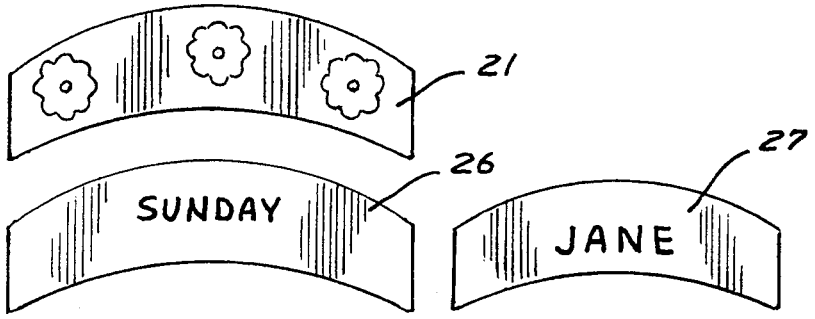
FIG. 5 is a front elevational view of some interchangeable display panels mountable on a headband base.
Figure 6:
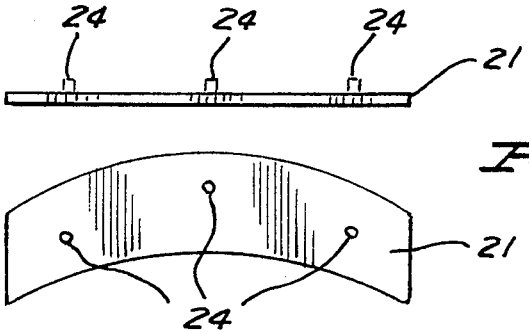
FIG. 6 is a back view and an end view of one of the display panels of FIG. 5.

As shown in FIG. 5, the headband kit will contain a plurality of display panels 21, 26, 27. The front display surface of the display panel can carry designs, such as a floral arrangement, animals, catch phrases, scenes or information such as the day of the week, a person's name, a cheerful salutation, or the like. As shown in FIG. 6, the display panel 21 is equipped with the mounting pegs 24 of sufficient number in order to assure that the display panel 21 will be securely affixed to the backboard 16. A display panel can be transparent except for the design thereon.

Figure 7:
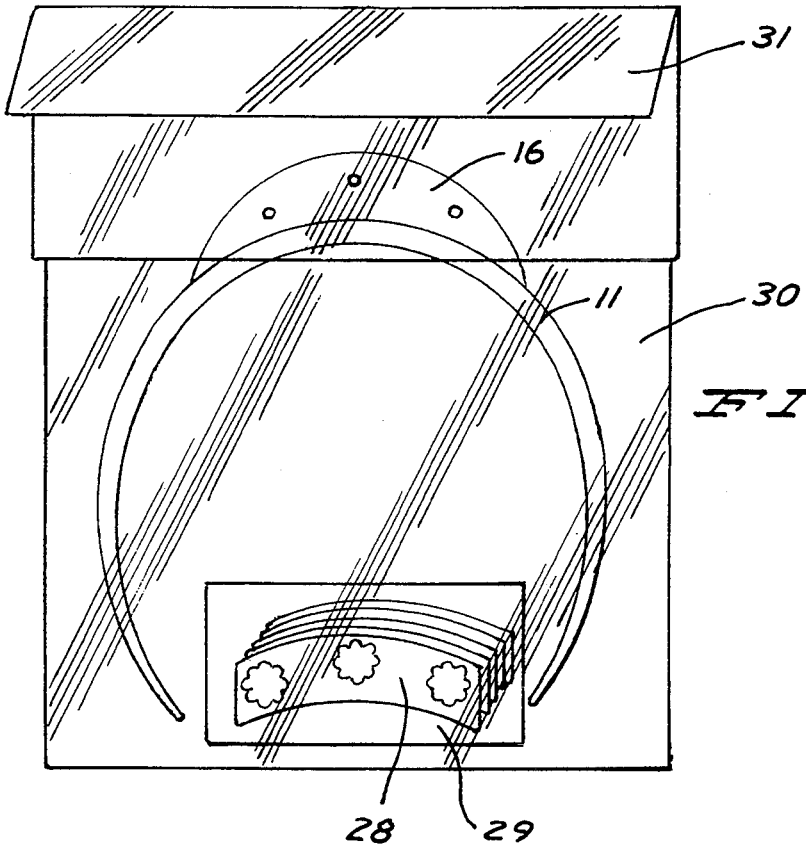
FIG. 7 is a packaged headband kit according to the invention.

The headband kit can come in a packaged kit form, as shown in FIG. 7. A plurality of interchangeable display panels, for example, five or seven, are placed in a decorative packet 29. The headband base 11 and backboard 16 assembly, along with the packet 29, are placed in a larger and sturdier plastic bag 30. A paper or cardboard display piece 31 is fixed to the top of the bag as by gluing and folds over the top to facilitate hanging and advertising.

The embodiments of the invention in which an exclusive property of privilege is claimed, are defined as follows:

1. A headband kit, comprising:

a base of resilient material, shaped like an open loop to conform to the head of a wearer when fitted over the top of the head;

a backboard fixed to the base, generally at the top thereof, when fitted on the head, said backboard being upwardly standing and having a forwardly facing display surface;

at least one removable display panel having a shape to fit on the display surface of the backboard; and releasably fastening means for releasably fastening the at least one display panel to the display surface of the backboard.

2. The headband kit of claim 1 including:

a plurality of display panels shaped to fit the backboard display surface, each having fastening means for releasably fastening to the backboard, each having a different display thereon.

3. The headband kit of claim 2 wherein:

said backboard is crescent shaped presenting a crescent shaped display surface.

4. The headband kit of claim 2 wherein:

the display panel has a mounting surface for mounting adjacent the display surface of the backboard, fastening means including mounting pegs on one surface and mounting openings in the other surface in registration with the mounting pegs.

5. The headband kit of claim 4 wherein:

said backboard is crescent shaped presenting a crescent shaped display surface.

6. The headband kit of claim 5 wherein:

said display panels have a truncated crescent shape.

7. The headband kit of claim 2 wherein:

said display panels have a truncated crescent shape.

8. The headband kit of claim 2 wherein:

said headband kit is packaged, said plurality of display panels being located in a first interior package;

a large exterior package; and said headband base and backboard being located in the large exterior package with the interior package.

9. The headband kit of claim 2 wherein:

one or more of the display panels are transparent, except for the design thereon.

10. The headband kit of claim 1 wherein:

said backboard is crescent shaped presenting a crescent shaped display surface.

* * * * *